United States Patent [19]

Howard

[11] 4,026,434

[45] May 31, 1977

[54] SWING DOWN CLOSET

[76] Inventor: Norman Walter Howard, 3803 Brooklyn Cres., NW., Calgary, Alberta, Canada, T2L 1G9

[22] Filed: June 18, 1976

[21] Appl. No.: 697,501

[52] U.S. Cl. ..... 220/18; 52/32; 312/247

[51] Int. Cl.[2] ..... A47B 46/00

[58] Field of Search ..... 312/246, 247, 248; 220/18; 52/32

[56] References Cited

UNITED STATES PATENTS

| | | | |
|---|---|---|---|
| 522,525 | 7/1894 | Houseman | 220/18 |
| 1,916,509 | 7/1933 | Hammer | 220/18 |
| 2,200,934 | 5/1940 | Platt | 52/32 |
| 3,627,397 | 12/1971 | Rominsky | 312/246 |

FOREIGN PATENTS OR APPLICATIONS

| | | | |
|---|---|---|---|
| 1,301,258 | 7/1962 | France | 312/247 |

*Primary Examiner*—Donald F. Norton

*Attorney, Agent, or Firm*—H. Wayne Rock

[57] ABSTRACT

A swing down closet comprises a generally box-like closet body which can be swung from an upper rest position to a lower work position while remaining generally upright, the closet being especially adapted for mounting in the entrance to a stairwell. A pair of parallel support members are mountable to the end wall of the entrance and each pivotally carries one end of a corresponding support arm, the other end of which is pivotally attached to a corresponding side of the closet body proximate the top thereof. Spring return means connected to the arm and to the end wall or the support members provide a force to return the closet body to the rest position. Automatic latch means on the support members engage the support arm at the "work" position to prevent unwanted return motion of the body. The latch means are actuated by downward movement of the closet body and released by further downward movement, after which the closet body may return to its rest position under the influence of the spring return means.

6 Claims, 3 Drawing Figures

SWING DOWN CLOSET

The present invention relates to a swing down closet which may be mounted in the stairwell of a descending staircase, the closet being normally positioned so that its interior is inaccessible but being movable to a position wherein its interior is readily accessible.

Most family dwellings are provided with a basement which is accessible via a descending staircase. The entrance to the staircase usually is of considerably greater volume than that required for human traffic and much of that volume is not utilized in a practical manner. Occasionally shelves are positioned in that volume but they are awkward to reach and hence their utilization is very limited.

The present invention provides a structure which can be mounted in the entrance volume of a staircase in order to efficiently utilize that space in a storage capacity. The invention provides an enclosed closet which is normally positioned in the entrance space so as to permit normal unimpeded traffic flow but which is swingable to a position adjacent the stairs so that access of the interior of the closet is readily attained. Spring return means are provided for returning the closet to its usual rest position and damping means may be provided to ease the closet into its rest position so that accelerations due to the spring return means are minimized.

An important feature of the present invention is the provision of automatic latch means which engage the closet so as to retain it in its lowered condition against the influence of the spring return means. The latch means is automatically engagable through descent of the closet body and it is releasable through further descent of the body whereby the spring return means can return the body to its rest position. Briefly, the present invention overcomes the problems of the prior art by providing a swing down closet comprising a closet body having top, bottom, back and side faces, a pair of rigid support members mountable to an appropriate support surface, a pair of support arms, each arm being pivotable at one end to a corresponding one of the support members and at the other end to one of the side faces proximate the top face, resilient return means connectable between each arm and the support surface and automatic latch means on at least one of the support members for engagement with at least the corresponding arm to lock the closet body against the force of the return means, the latch means being engagable through downward movement of the closet body and releasable through further downward movement of the closet body.

Figure 1:
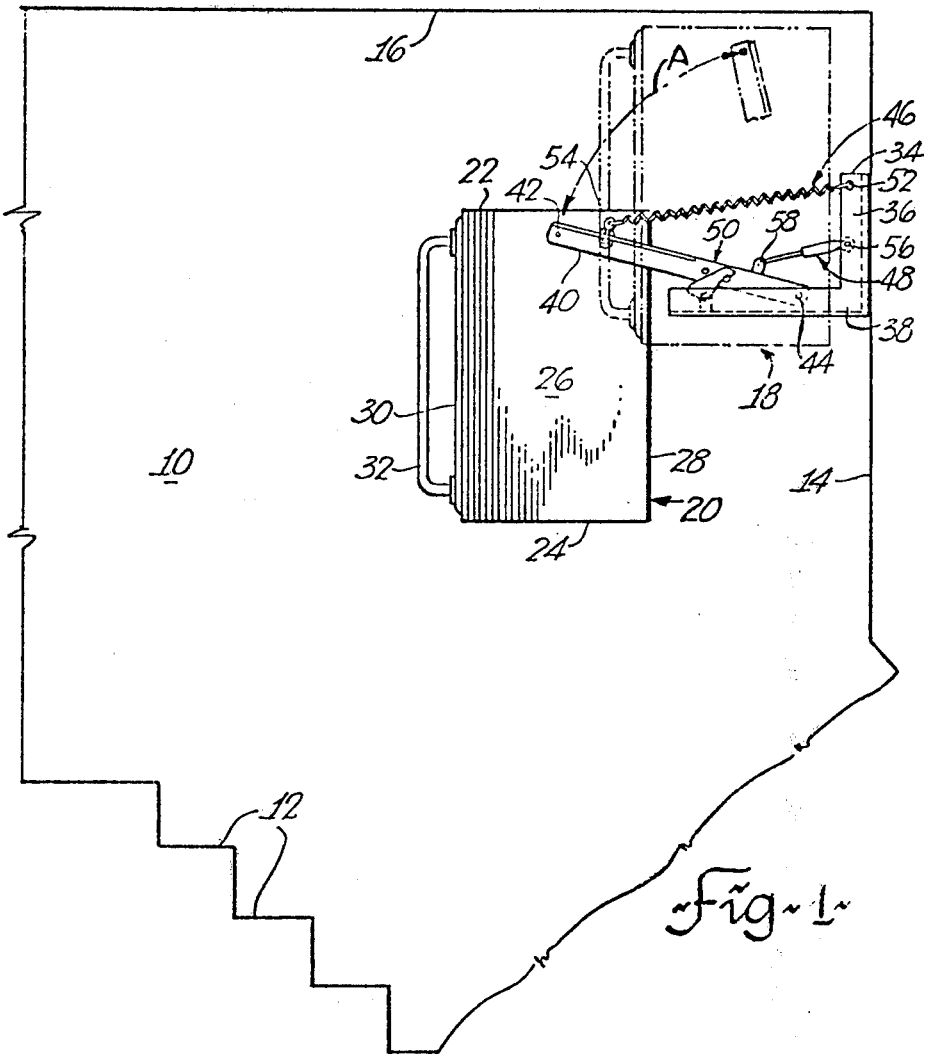
Figure 2:
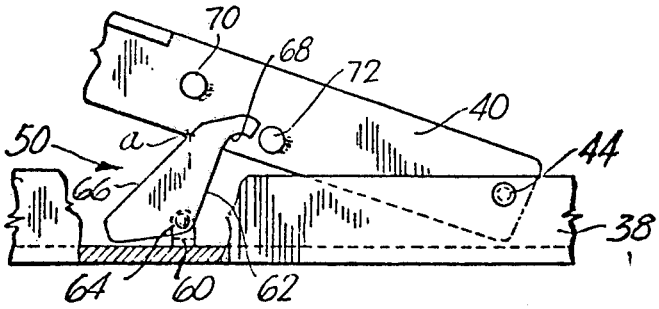
Figure 3:
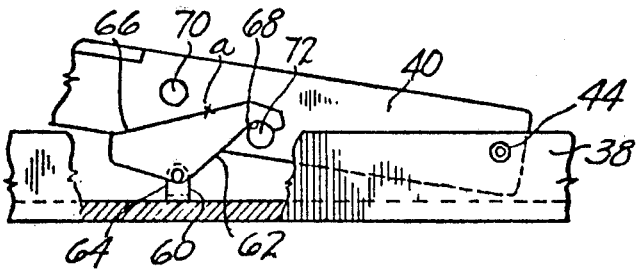

The invention will now be described in greater detail and with reference to the drawings wherein:

FIG. 1 is a general side view of the present invention with the closet body shown in a lowered position, FIG. 2 is a simplified view of the automatic latch means prior to engagement and, FIG. 3 is a simplified view of the automatic latch means after engagement.

FIG. 1 illustrates the present invention in its normal environment, namely a stairwell 10 containing a descending staircase 12. Facing the entrance to the stairwell, and therewithin, is wall 14 which can serve as a support surface for the present invention. The ceiling of the entrance to the stairwell is shown by reference number 16.

The swing-down closet of the present invention is referenced generally by number 18. It comprises a closet body 20 which may be of any shape, although a generally rectangular configuration is preferred. Thus the closet body 20 is composed of a top face 22, a bottom face 24, side faces 26 (only one is shown), a back face 28 and a front 30. Each of the faces will usually be a planar surface, perhaps constructed from wood or sheet metal. The front 30 can be open, or closed by a door (not shown) depending on the preference of the user. A handle 32 is shown as extending from adjacent the top face 22 to adjacent the bottom face 24 and projecting outwardly of the front 30. A single handle can be provided at one side of the front or two could be provided, one at each side. Other styles of handles could be utilized as long as they can be reached by a user when the closet body is in its normal rest position, which position is shown in dash-dot outline in FIG. 1.

FIG. 1 also illustrates the mechanism of support for the present invention. A pair of rigid support members 34 are provided for mounting to the support surface 14. In the embodiment shown each support member 34 is in the form of an "L" shaped bracket positioned outboard of each side face 26 of the closet body. As illustrated the bracket may be formed of angle-iron whereby the legs of the angle-iron serve as flanges for conveniently mounting the bracket to the support surface and for mounting the ancillary equipment soon to be described. When mounted as in FIG. 1, one arm 36 of the support member 34 is positioned against support surface 14 and fixed thereto while the other arm 38 projects outwardly from the support surface, generally at right angles thereto. While it is desirable that the arms 38 of the two support members 34 be parallel to each other, it is not essential that the angle between arms 36 and 38 be 90°. In fact, specific space considerations may necessitate support members which differ considerably from the configuration portrayed in FIG. 1.

A pair of support arms 40 are also provided, one arm 40 corresponding to one support member 34. Thus one end of each arm 40 is pivoted to the closet body 20 as by pivot pin 42 positioned in a side face 26 proximate the top face 22. Preferably the pivot pin 42 is located generally in the same vertical plane as the center of gravity of the closet body so that the latter will hang with a generally vertical attitude. The other end of each arm 40 is pivotally connected to arm 38 of a support member 34, the pivot point, as shown, being outwardly of the supporting surface. It should be pointed out that while the support arm 40 is also shown as being constructed of angle-iron, such construction is not essential to the present invention. It is only essential that the support arm 40 be pivotable relative to the closet body 20 and its associated support member 34 and that it be adaptable to receive the equipment to be described relative thereto. That equipment includes resilient return means 46, damping means 48 and automatic latch means 50.

Resilient return means 46 extend between support arm 40 and arm 36 of support member 34. The connection to arm 36 and arm 40 may be of any conventional form, as by eyes 52 and 54 respectively. Should, however, support members different in configuration from those shown be used, the resilient return means may be connected directly to the support surface 14. Resilient return means 46 are provided to aid in the raising of closet body 20 from its "work" position to its rest position and hence a helical tension spring is preferable. The spring rate should be chosen so that the acceleration of the returning closet body is not so great that the damage to the goods in the close body results. If the closet body is to hold heavy articles and a heavy spring return means is specified, the storage of light goods could result in those high accelerations under the influence of the spring means 46. Thus it is advantageous to provide damping means such as an air cylinder 48 to work against the spring means to thereby reduce the accelerations smoothly as the closet body approaches its rest position. The damping means 48 may be connected as at 46 and 58 in much the same manner as spring return means 46.

It may happen, as suggested above, that the closet body may be lightly loaded and that consequently the weight of the closet body and the load is not sufficient to hold the body in its lowered "work" position. In order to maintain the closet body in its lowered position automatic latch means 50 are provided. A lug 60 is mounted on arm 38 between its outer end and pivot 44, as shown in simplified form in FIGS. 2 and 3. Lug 60 projects upwardly and has a latch plate 63 pivotally connected thereto as at 64. The pivot connection is such that absent any external forces the latch plate is gravity biased to the disengaged position as shown in FIG. 2 but it is movable to the position of FIG. 3 under the influence of a suitably directed force. Latch plate 62 is also provided with a sloping camming surface 66 and a lock portion 68 which is advantageously an arc of a circle. Arm 40 is provided with first pin means 70 and second pin means 72 projecting outwardly from the side surface thereof and positioned much as in FIGS. 2 and 3. Thus pin means 70 is slightly above pin means 72 and is located more towards closet body 20.

The operation of the swing down closet of the present invention will now be described with reference to the drawings. With the closet body 20 in its rest position as shown in dash-dot lines in FIG. 1, descent is initiated by a person grasping the handle 32 and exerting a downward and outward pull. The closet body will follow generally the curved path A from its rest position to its "work" position, extending spring return means 46 and damping means 48. Latch plate 62 will be in its usual rest position as shown in FIG. 2 and as arm 40 descends the upper portion of latch plate 62 will pass between pin means 70 and 72. Continued descent will bring pin means 70 into contact with camming surface 66 as at position *a* and a force is exerted so as to cam the latch plate from its rest position of FIG. 2 to the locking position of FIG. 3 wherein lock portion 68 is engageable with second pin means 72 upon relaxation of the downward pull. Thus the closet body is restrained from upward movement.

In order to permit upward movement it is first necessary to release latch means 50. This is also done automatically through a downward movement of closet body 20. Such downward movement releases pin means 72 from the lock portion 68 and then the gravity bias on the latch plate 62 due to the positioning of pivot 64 will provide a rotative force which returns the latch plate to its disengaged position of FIG. 2. The closet body can then be raised under the influence of the spring return means and whatever physical exertion may be necessary. Damping means 48 will ensure that the closet body is travelling sufficiently slowly as it reaches its rest position that the contents will not be overly jostled as it comes to a halt. If the damping means is an air cylinder as shown the travel of the piston and rod will limit the upwards and perhaps the downwards travel of the closet body, as will the configuration of spring return means. If required, appropriate stop means can be provided to limit travel of the closet body.

It is understood that the embodiment of the present invention as illustrated is a preferred embodiment. Variations in specific structural details can be made without affecting the overall concept of the invention, the scope of which is defined by the appended claims.

I claim:

1. A swing down closet comprising a closet body having top, bottom, back and side faces, a pair of rigid support members mountable to an appropriate support surface, a pair of support arms, each arm being pivotable at one end to a corresponding one of said support members and at the other end to one of said side faces proximate said top face, resilient return means connectable between each said arm and said support surface and automatic latch means on at least one of said support members for engagement with at least the corresponding arm to lock said closet body against the force of said return means, said latch means being engagable through downward movement of said closet body and releasable through further downward movement of said closet body.

2. The invention of claim 1 wherein said latch means comprises a latch plate pivotably mounted to said at least one support member so as to be gravity biased to a disengaged position, said latch plate including a camming surface and a lock portion, and first and second pin means on said corresponding support arm.

3. The invention of claim 2 wherein said first and second pin means project outwardly from said corresponding support arm whereby said first pin means is engagable with said camming surface to cam said latch plate from said disengaged position into a position for engagement of said lock portion with said second pin means, release of said second pin means from said lock portion permitting said latch plate to return, under gravity bias, to said disengaged position.

4. The invention of claim 1 and including damping means connected between at least one of said support arms and said support surface.

5. A swing down closet comprising a closet body having top, bottom, back and side faces, a pair of rigid support members mountable to an appropriate support surface, a pair of support arms, each arm being pivotable at one end to a corresponding one of said support members and at the other end to one of said side faces proximate said top face, spring means connected between each said arm and the corresponding support member, and automatic latch means comprising a latch plate pivoted to one of said support members and having a camming surface along one edge and a lock portion, said camming surface being engagable with first pin means on said arm for pivoting said plate whereby said lock portion is engagable with second pin means on said arm, further engagement of said first pin means with said camming surface disengaging said lock portion from said second pin means.

6. The invention of claim 5 and including damping means connected between at least one of said support arms and said support surface.

* * * * *